US010641132B2

(12) United States Patent
Cha

(10) Patent No.: US 10,641,132 B2
(45) Date of Patent: May 5, 2020

(54) SUPERCRITICAL CO2 POWER GENERATING SYSTEM FOR PREVENTING COLD-END CORROSION

(71) Applicant: DOOSAN HEAVY INDUSTRIES & CONSTRUCTION CO., LTD., Changwon-si, Gyeongsangnam-do (KR)

(72) Inventor: Song Hun Cha, Osan-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 23 days.

(21) Appl. No.: 16/029,651

(22) Filed: Jul. 9, 2018

(65) Prior Publication Data

US 2019/0017417 A1 Jan. 17, 2019

(30) Foreign Application Priority Data

Jul. 17, 2017 (KR) ..... 10-2017-0090491
Jul. 17, 2017 (KR) ..... 10-2017-0090492

(51) Int. Cl.
*F01K 7/32* (2006.01)
*F01K 13/00* (2006.01)
(Continued)

(52) U.S. Cl.
CPC ..... *F01K 7/32* (2013.01); *F01K 11/02* (2013.01); *F01K 13/003* (2013.01); *F01K 13/02* (2013.01); *F01K 25/103* (2013.01)

(58) Field of Classification Search
CPC ..... F01K 7/32; F01K 25/103; F01K 11/02; F01K 13/02; F01K 13/003; F01K 13/00;
(Continued)

(56) References Cited

U.S. PATENT DOCUMENTS

2012/0131921 A1* 5/2012 Held ..... F01K 25/08 60/671
2014/0102098 A1* 4/2014 Bowan ..... F01K 7/32 60/645
(Continued)

FOREIGN PATENT DOCUMENTS

JP H08-035404 A 2/1996
JP H09-209715 A 8/1997
(Continued)

OTHER PUBLICATIONS

A Korean Office Action dated Oct. 29, 2018 in connection with Korean Patent Application No. 10-2017-0090491 which corresponds to the above-referenced U.S. application.
(Continued)

*Primary Examiner* — Hoang M Nguyen
(74) *Attorney, Agent, or Firm* — Invenstone Patent, LLC

(57) ABSTRACT

A supercritical $CO_2$ power generating system prevents cold-end corrosion capable of improving reliability against cold-end corrosion by including a recirculation pump. Part of the working fluid heated in the low-temperature-side external heat exchanger using the recirculation pump is mixed with the low-temperature working fluid at the rear end of the pump, to heat the working fluid above the temperature of the dewpoint of the waste heat gas. The heated working fluid is then supplied to the external heat exchanger. By reducing the cold-end corrosion phenomenon of the low-temperature-side external heat exchanger, the life of the external heat exchanger can be increased and the reliability of the external heat exchanger and the supercritical $CO_2$ power generating system can be improved.

18 Claims, 10 Drawing Sheets

(51) Int. Cl.
*F01K 13/02* (2006.01)
*F01K 11/02* (2006.01)
*F01K 25/10* (2006.01)

(58) Field of Classification Search
CPC ..... F01K 17/02; F01K 21/00; F01K 27/00; F01D 15/10
USPC ..... 60/670–681
See application file for complete search history.

(56) References Cited

U.S. PATENT DOCUMENTS

2015/0076831 A1* 3/2015 Giegel ..... F01K 25/08 290/1 R
2016/0017759 A1* 1/2016 Gayawal ..... F01K 13/02 60/670
2016/0040557 A1* 2/2016 Vermeersch ..... F01K 7/32 60/653

FOREIGN PATENT DOCUMENTS

KR 10-2016-0033043 A 3/2016
KR 10-2016-0123278 A 10/2016

OTHER PUBLICATIONS

A Korean Office Action dated Oct. 29, 2018 in connection with Korean Patent Application No. 10-2017-0090492 which corresponds to the above-referenced U.S. application.

* cited by examiner

[FIG. 1]
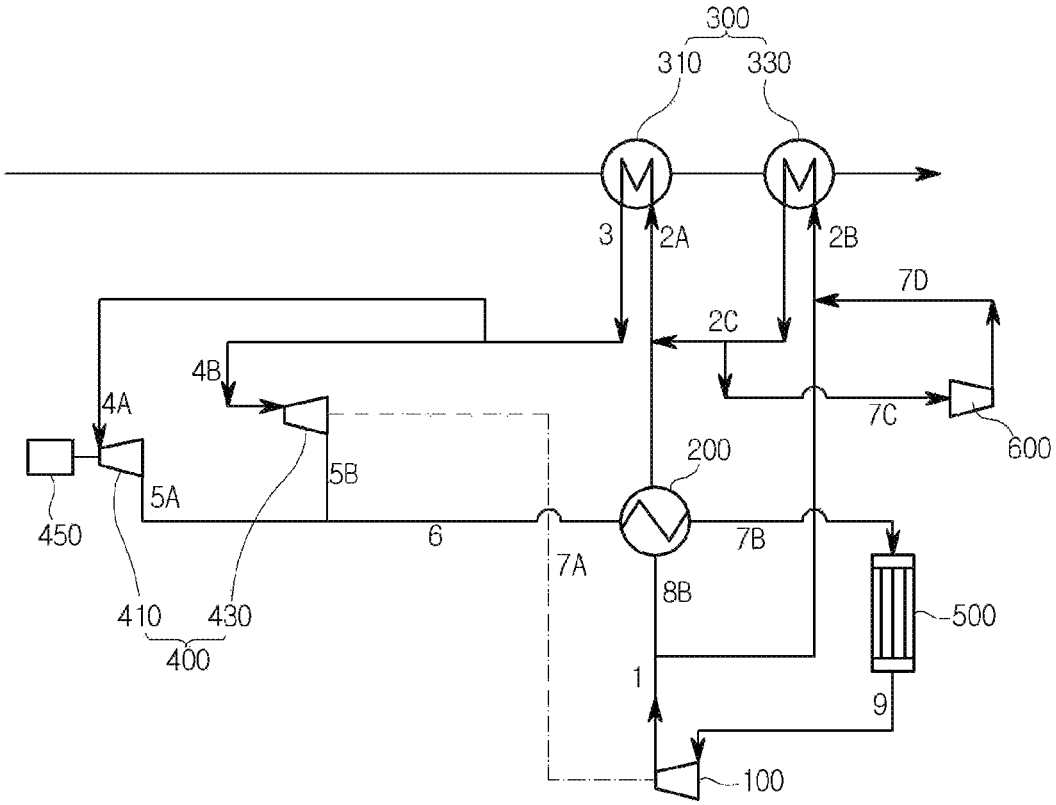

[FIG. 2]
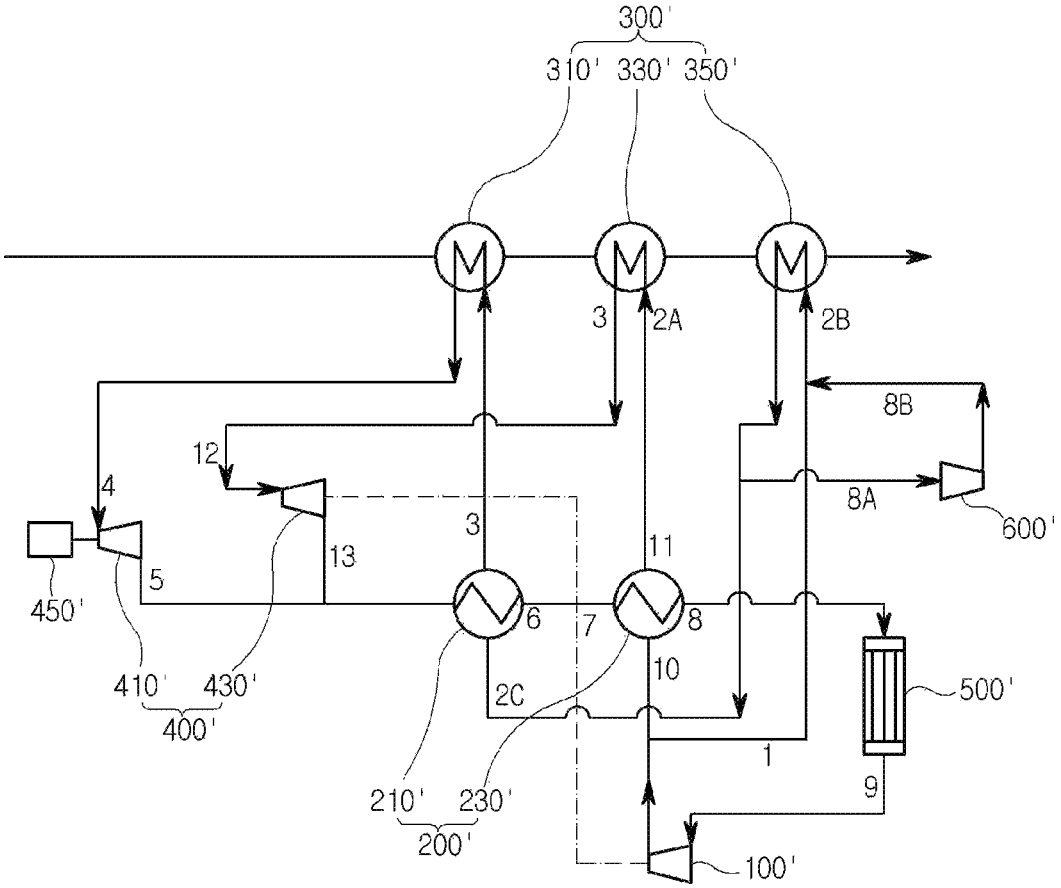

[FIG. 3]
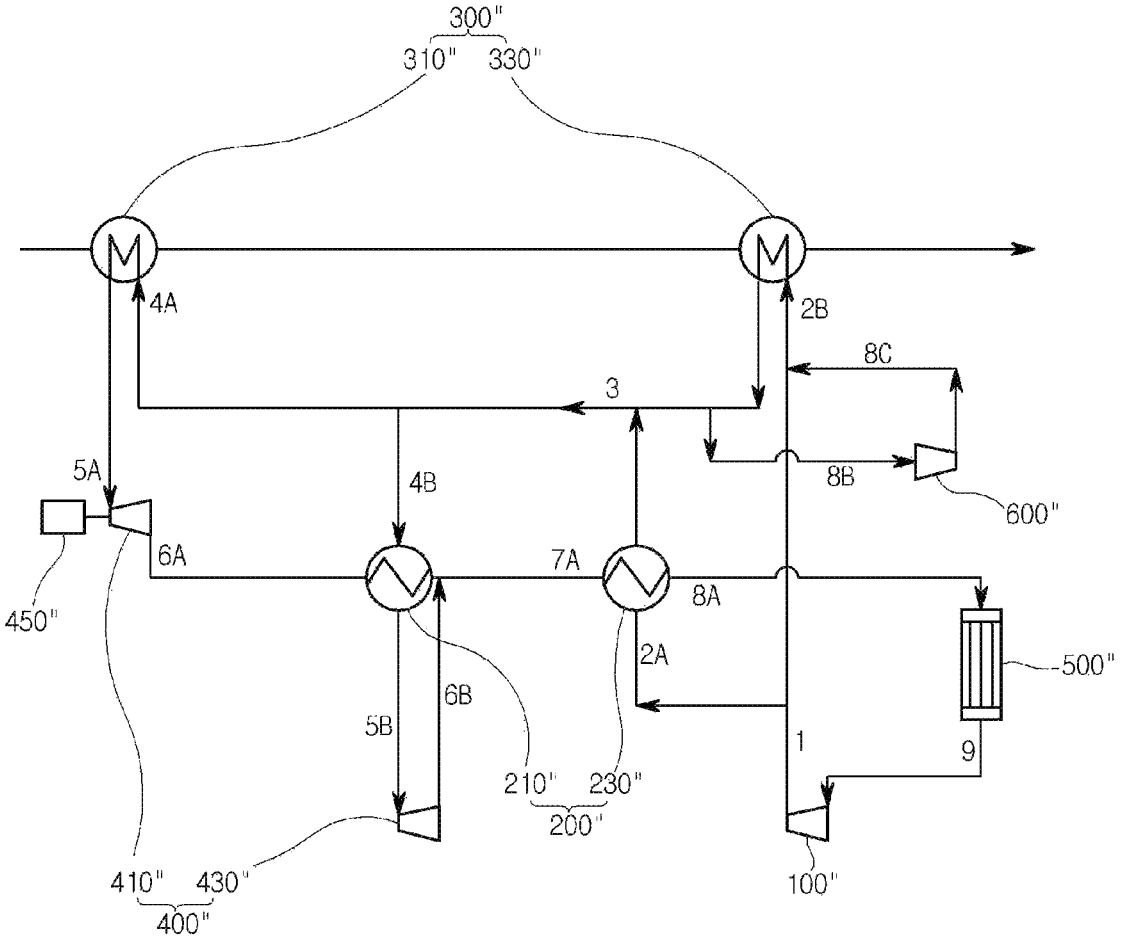

[FIG. 4]
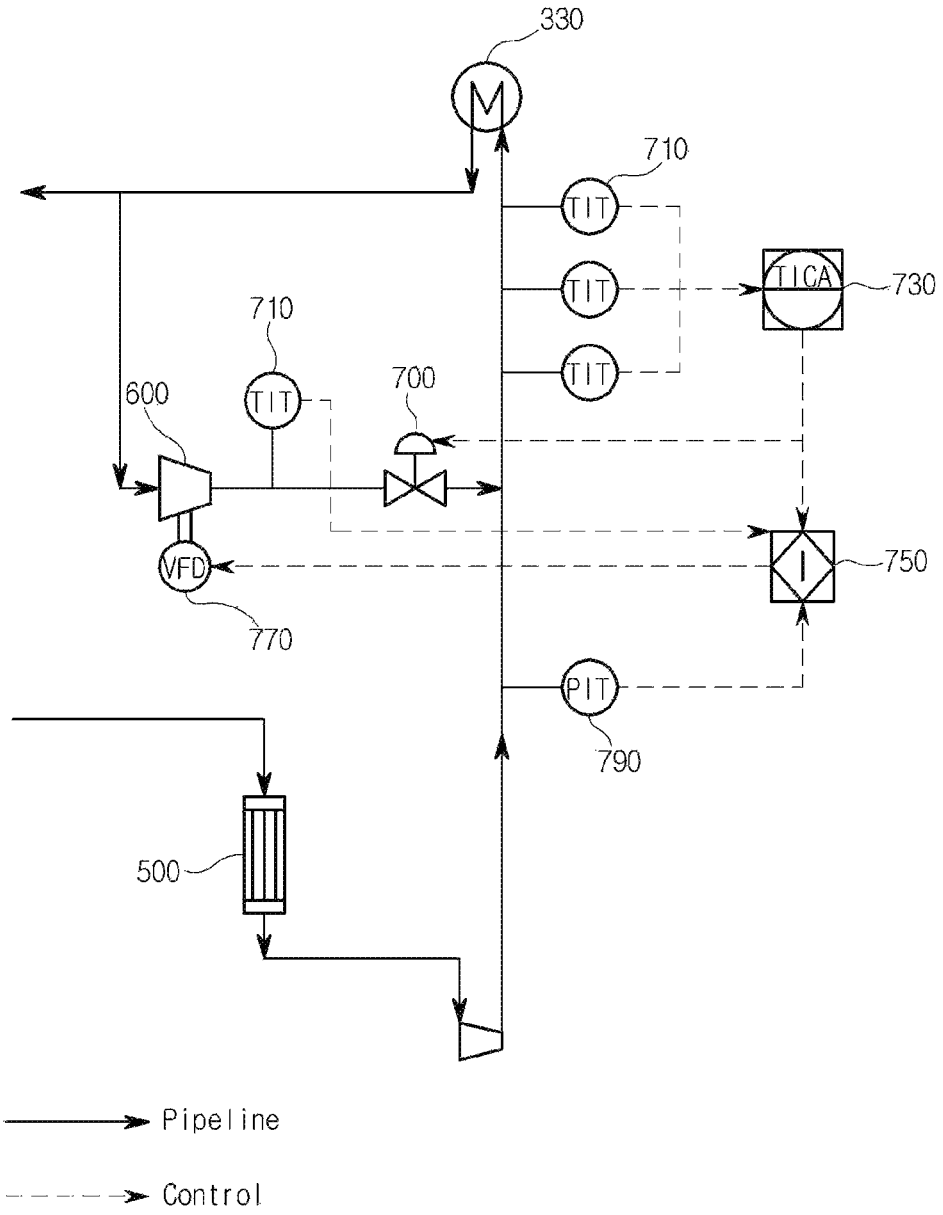

[FIG. 5]
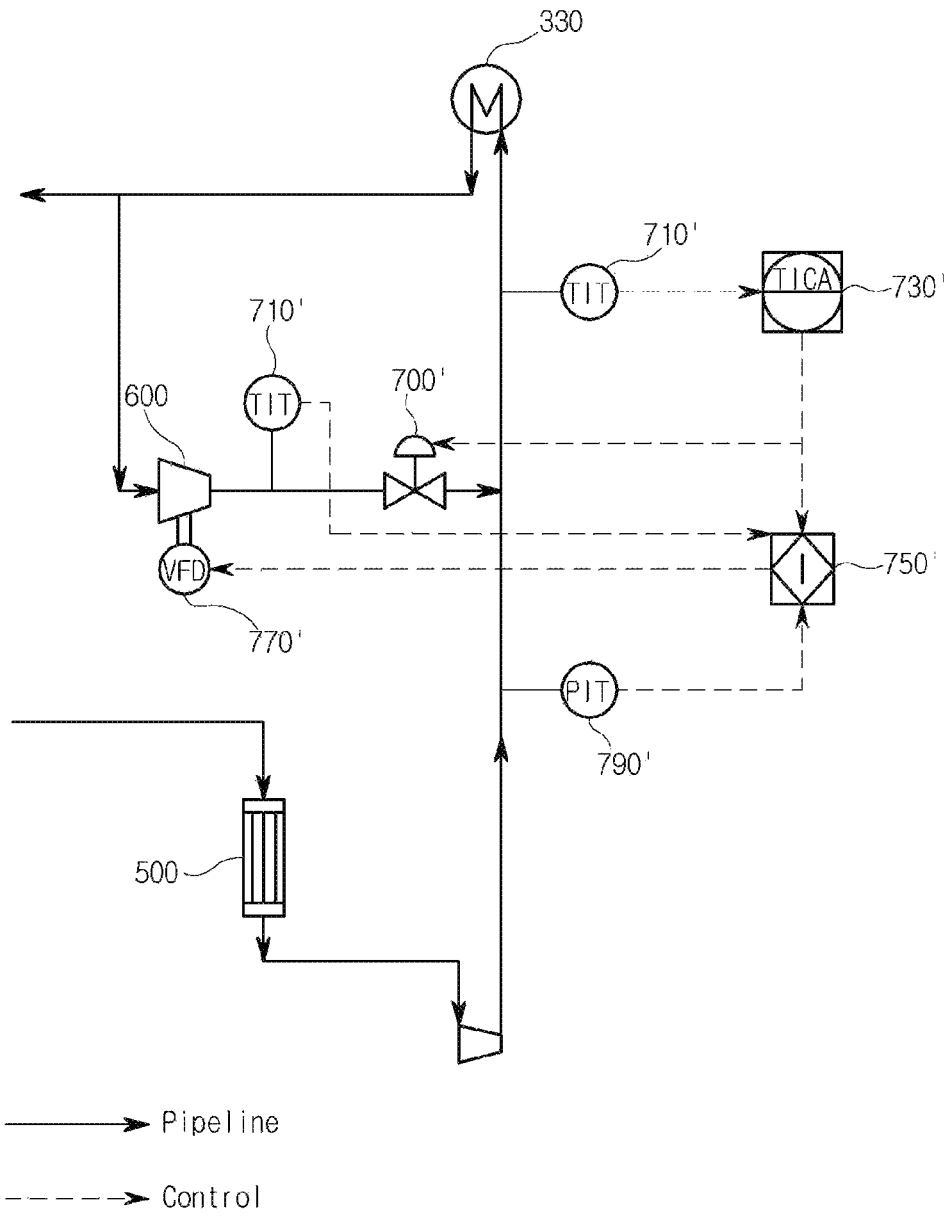

[FIG. 6]
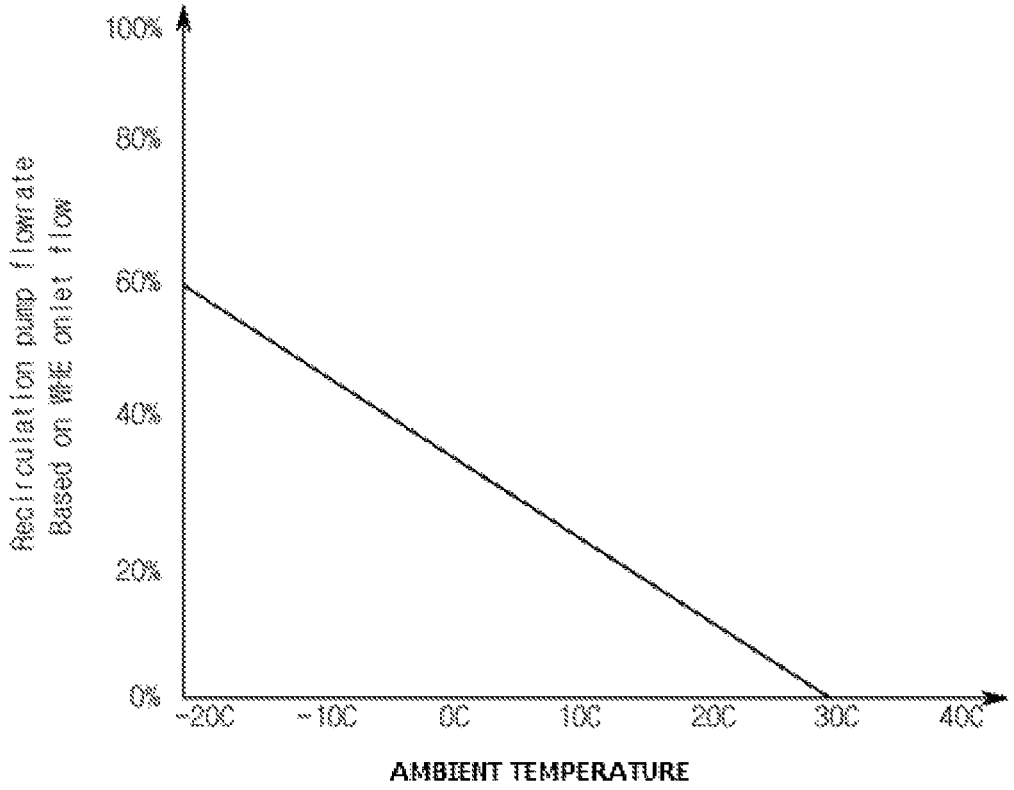

[FIG. 7]
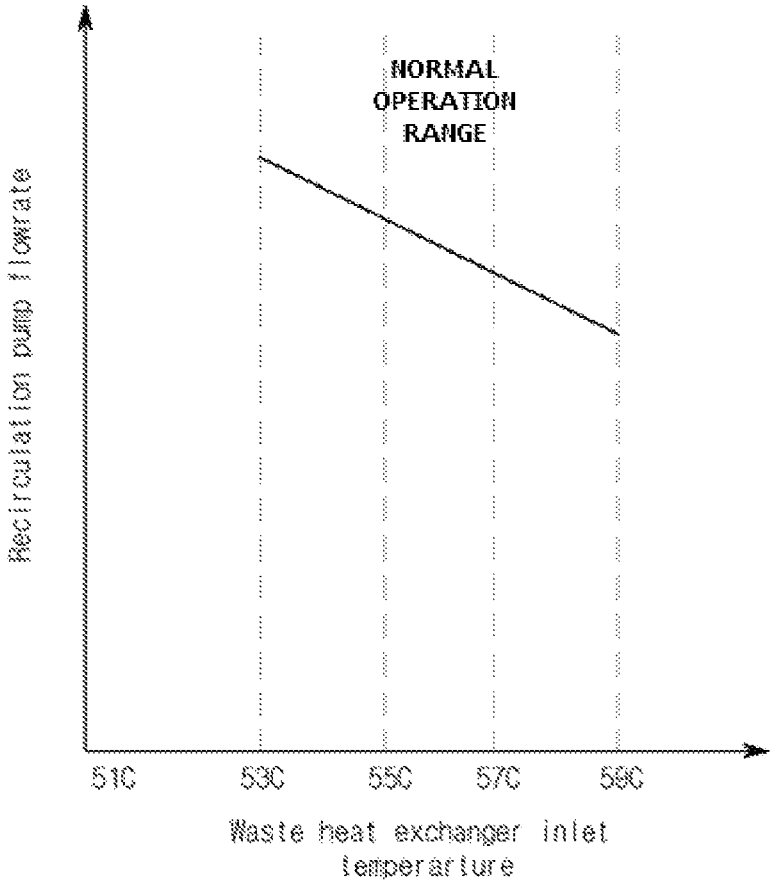

[FIG. 8]
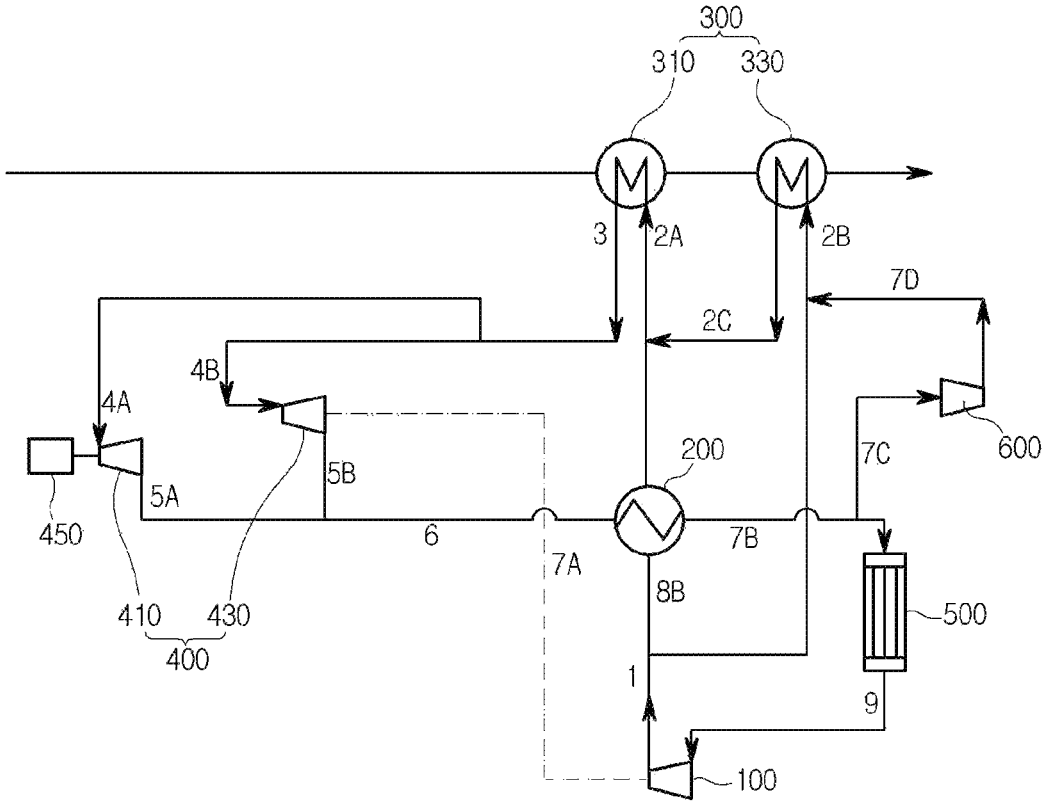

[FIG. 9]
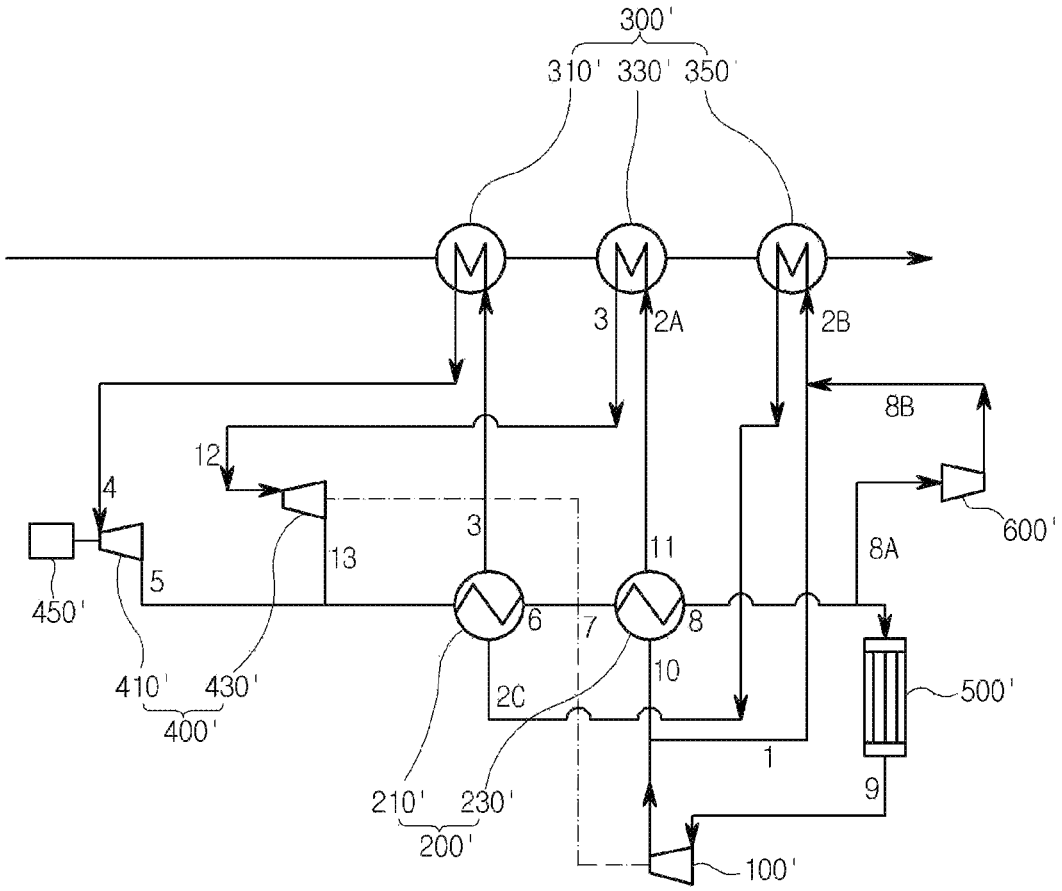

[FIG. 10]
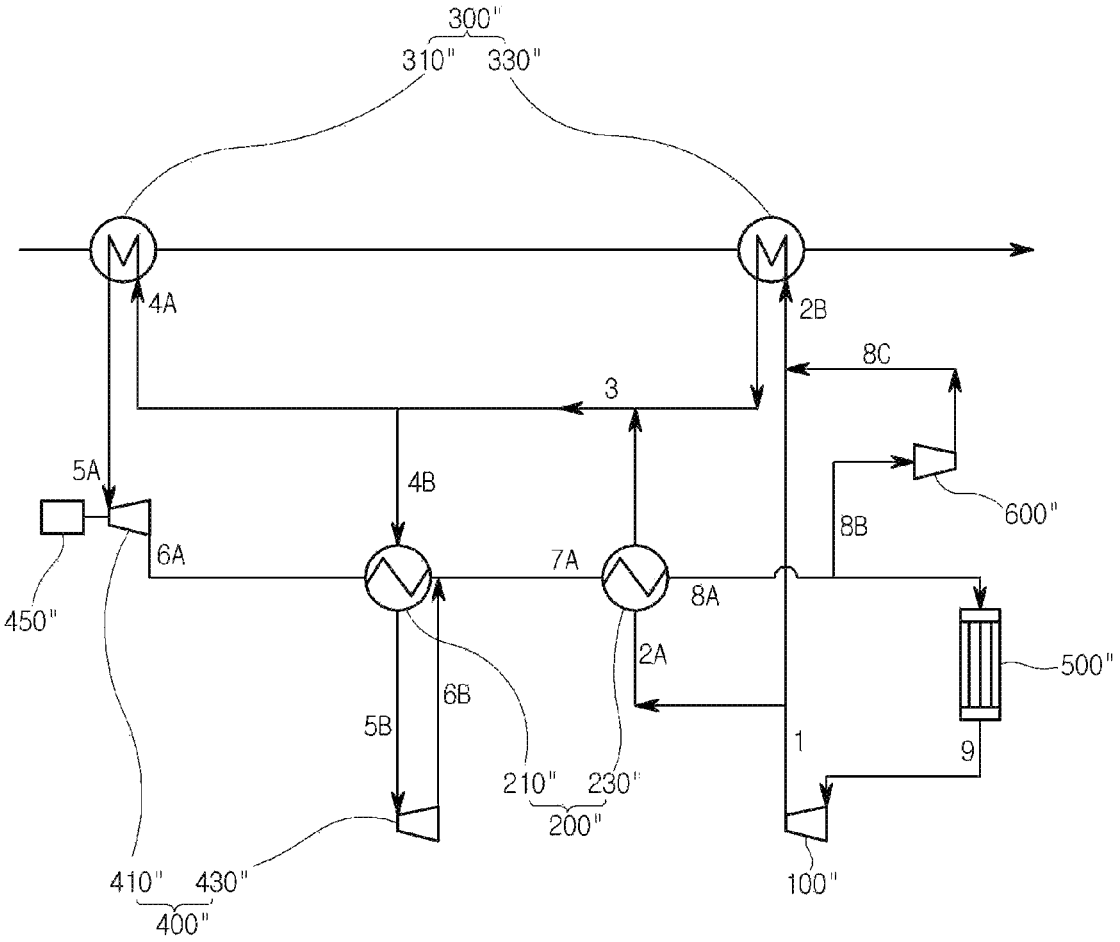

SUPERCRITICAL CO2 POWER GENERATING SYSTEM FOR PREVENTING COLD-END CORROSION

CROSS-REFERENCE TO RELATED APPLICATIONS

This application claims priority to Korean Patent Application Nos. 10-2017-0090491 filed on Jul. 17, 2017, and 10-2017-0090492 filed on Jul. 17, 2017, the disclosure of which is incorporated herein by reference in its entirety.

BACKGROUND OF THE DISCLOSURE

Field of the Disclosure

Exemplary embodiments of the present disclosure relate to a supercritical $CO_2$ power generating system for preventing cold-end corrosion, and more particularly, to such a system capable of improving reliability against cold-end corrosion by including a recirculation pump.

Description of the Related Art

As the need for efficient power production increases, and as the move toward decreasing the emission of pollutants (e.g., greenhouse gases) goes global, there have been several active efforts to increase power production while decreasing emissions. As an example of one such effort, there is the research and development of a power generating system using supercritical $CO_2$ as a working fluid.

Supercritical $CO_2$ has a similar density to a liquid-state fluid and a similar viscosity to other gases, so it is possible to miniaturize a power generation device and significantly decrease the power consumption required for compression and circulation of a fluid. At the same time, supercritical $CO_2$ having a critical point at 31.4° C. and 72.8 atm, which is much lower than that of water having a critical point at 373.95° C. and 217.7 atm, may be relatively easily handled. In addition, power generating systems using supercritical $CO_2$ are mostly operated as a closed cycle, in which the carbon dioxide used for power generation is not emitted to the outside, and thus can greatly contribute to reducing a country's emission of greenhouse gases.

However, beyond a certain scale, it is difficult to increase the capacity of existing power generating systems using supercritical $CO_2$, such that goals for increased power can only be partial met. In the case of coal-fired power generation, it is particularly necessary to reduce emissions while increasing the power generation efficiency.

U.S. Patent Publication No. 2014-0102098 discloses a method to increase the efficiency of a supercritical $CO_2$ power generating system, by additionally supplying heat to a working fluid using an external heat exchanger capable of recovering waste heat such as exhaust gas discharged from a boiler of a thermal power plant. However, there is an inherent problem with such external heat exchangers.

Generally, upon exchanging heat with waste heat gas, if the temperature of a cold-side working fluid of the external heat exchanger is lower than the dewpoint of sulfuric acid contained in the waste heat gas, water may condense on the high-temperature-side, i.e., the side into which the waste heat gas is introduced. Water condensation may lead to corrosion when condensed water droplets adhere to and accumulate in a metal tube of the external heat exchanger. This corrosion phenomenon is called cold-end corrosion.

Cold-end corrosion shortens the lifetime of the external heat exchanger and lowers its reliability, and in turn, lowers the overall reliability of the supercritical $CO_2$ power generating system. Therefore, a method for solving these problems is needed.

SUMMARY OF THE DISCLOSURE

An object of the present disclosure is to provide a supercritical $CO_2$ power generating system which is capable of improving system reliability by including a recirculation pump in order to guard against cold-end corrosion.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided a power generating system using supercritical $CO_2$ as a working fluid for driving a turbine. The system may include a plurality of heat exchangers for heating the working fluid using heat supplied from an external heat source, the plurality of heat exchangers including a low-temperature-side heat exchanger; a pump for compressing the working fluid, the working fluid passing through the pump being branched into a first part of the working fluid and a second part of the working fluid for supplying the low-temperature-side heat exchanger; at least one recuperator for exchanging heat between the working fluid passing through the turbine and the first part of the working fluid passing through the pump, to cool the working fluid from the turbine and to heat the working fluid from the pump; and a condenser for cooling the working fluid primarily cooled by the at least one recuperator and supplying the cooled working fluid to the pump, wherein the second part of the working fluid passing through the pump is mixed with an additional part of the working fluid to be supplied to the low-temperature-side heat exchanger.

The additional part of the working fluid to be supplied to the low-temperature-side heat exchanger may be branched from an outlet of the low-temperature-side heat exchanger or from an inlet of the condenser.

The system may further include a recirculation pump for pressurizing the additional part of the working fluid to be supplied to the low-temperature-side heat exchanger.

The plurality of heat exchangers may use waste heat gas as the external heat source and may include a high-temperature-side heat exchanger which is adjacent to an inlet end into which the waste heat gas is introduced from the external heat source, and the low-temperature-side heat exchanger which is adjacent to an outlet end from which the waste heat gas is discharged.

The working fluid passing through the recirculation pump may include the additional part of the working fluid to be supplied to the low-temperature-side heat exchanger, and the working fluid supplied to the low-temperature-side heat exchanger may be the mixture of the second part of the working fluid and the additional part of the working fluid. Here, the temperature of the working fluid supplied to the low-temperature-side heat exchanger may be above a dewpoint temperature of the waste heat gas supplied to the low-temperature-side heat exchanger.

To control a flow rate of the working fluid supplied to the low-temperature-side heat exchanger, the system may further include a control valve connected to an outlet of the recirculation pump and/or a variable frequency driver provided to the recirculation pump.

The system may further include at least one temperature indicating transmitter for measuring the temperature of the working fluid at the inlet of the low-temperature-side heat exchanger. The system may further include a controller connected to the temperature indicating transmitter to control, based on the measured temperature, a flow rate of the working fluid supplied to the low-temperature-side heat exchanger.

The controller may increase the flow rate of the working fluid supplied to the recirculation pump, if the temperature of the waste heat gas introduced into the low-temperature-side heat exchanger is lower than a preset temperature or if the temperature of the working fluid introduced into the low-temperature-side heat exchanger is lower than the preset temperature. Conversely, the controller may decrease the flow rate of the working fluid supplied to the recirculation pump, if the temperature of the waste heat gas introduced into the low-temperature-side heat exchanger is higher than a preset temperature or if the temperature of the working fluid introduced into the low-temperature-side heat exchanger is higher than the preset temperature.

In accordance with another aspect of the present disclosure, the system may include a plurality of heat exchangers for heating the working fluid using heat supplied from an external heat source, the plurality of heat exchangers including a low-temperature-side heat exchanger and at least one of a high-temperature-side heat exchanger and a middle-temperature heat exchanger; a pump for compressing the working fluid, the working fluid passing through the pump being branched into a first part of the working fluid and a second part of the working fluid for supplying the low-temperature-side heat exchanger; at least one recuperator for exchanging heat between the working fluid passing through the turbine and the first part of the working fluid passing through the pump, to cool the working fluid from the turbine and to heat the working fluid from the pump; a condenser for cooling the working fluid primarily cooled by the at least one recuperator and supplying the cooled working fluid to the pump; and a recirculation pump connected to either an outlet of the low-temperature-side heat exchanger in order to recirculate part of the working fluid discharged from the low-temperature-side heat exchanger, or to an inlet of the condenser in order to recompress part of the working fluid supplied to the condenser, wherein the low-temperature-side heat exchanger is supplied with a mixture of the working fluid passing through the recirculation pump and the second part of the working fluid passing through the pump.

The plurality of heat exchangers may use waste heat gas as the external heat source and may include a high-temperature-side heat exchanger which is adjacent to an inlet end into which the waste heat gas is introduced from the external heat source, and the low-temperature-side heat exchanger which is adjacent to an outlet end from which the waste heat gas is discharged. The mixture of the working fluid passing through the recirculation pump and the second part of the working fluid passing through the pump may have a temperature above a dewpoint temperature of the waste heat gas supplied to the low-temperature-side heat exchanger.

The supercritical $CO_2$ power generating system for preventing cold-end corrosion according to an embodiment of the present disclosure mixes part of the working fluid heated in the low-temperature-side external heat exchanger using the recirculation pump with the low-temperature working fluid at the rear end of the pump to heat the working fluid above the temperature of the dewpoint of the waste heat gas and supply the heated working fluid to the external heat exchanger. Accordingly, it is possible to increase the life of the external heat exchanger and improve the reliability of the external heat exchanger and the supercritical $CO_2$ power generating system by reducing the cold-end corrosion phenomenon of the low-temperature-side external heat exchanger.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a schematic diagram of a supercritical $CO_2$ power generating system according to a first embodiment of the present disclosure;

FIG. 2 is a schematic diagram of a supercritical $CO_2$ power generating system according to a second embodiment of the present disclosure;

FIG. 3 is a schematic diagram of a supercritical $CO_2$ power generating system according to a third embodiment of the present disclosure;

FIG. 4 is a schematic diagram of an example configuration of a recirculation pump side of FIGS. 1 to 3;

FIG. 5 is a schematic diagram of another example configuration of the recirculation pump side of FIGS. 1 to 3;

FIG. 6 is a graph showing the relationship between an ambient temperature and a flow rate of a working fluid of the recirculation pump according to the system of FIGS. 1 to 3;

FIG. 7 is a graph showing the relationship between an inlet temperature of the external heat exchanger and a flow rate of the working fluid of the recirculation pump according to the system of FIGS. 1 to 3;

FIG. 8 is a schematic diagram of a supercritical $CO_2$ power generating system according to a fourth embodiment of the present disclosure;

FIG. 9 is a schematic diagram of a supercritical $CO_2$ power generating system according to a fifth embodiment of the present disclosure; and FIG. 10 is a schematic diagram of a supercritical $CO_2$ power generating system according to a sixth embodiment of the present disclosure.

DESCRIPTION OF SPECIFIC EMBODIMENTS

Hereinafter, a supercritical $CO_2$ power generating system according to an embodiment of the present disclosure will be described in detail with reference to the accompanying drawings.

Generally, a supercritical $CO_2$ power generating system uses supercritical $CO_2$ as a working fluid for power generation and is a closed system which does not discharge $CO_2$ outside the system.

Since the supercritical $CO_2$ power generating system uses supercritical $CO_2$ as a working fluid, the system may make use of exhaust gas discharged from a thermal power plant or the like. Therefore, the supercritical $CO_2$ power generating system may not only be used as a single power generating system, but may also be used in a hybrid power generating system together with a thermal power generating system. The working fluid of the supercritical $CO_2$ power generating system may be supplied by separating $CO_2$ from the exhaust gas, or a separate $CO_2$ source may be employed.

The supercritical $CO_2$ flowing in the cycle (hereinafter referred to as working fluid) passes through a pump and is then heated while passing through a heat source, such as a heater or similar device, to become a high-temperature and high-pressure working fluid, thereby operating a turbine. A generator or a pump is connected to the turbine, power is generated by the turbine connected to the generator, and the pump is operated by using the turbine connected to the pump. The working fluid passing through the turbine is cooled while passing through the heat exchanger, and the cooled working fluid is resupplied to the pump to be circulated in the cycle. The turbine or the heat exchanger may be provided in plural.

The supercritical $CO_2$ power generating system according to various embodiments of the present disclosure include not only a system in which all working fluids flowing in the cycle are supercritical, but also a system in which only most working fluids are supercritical (the remainder being subcritical).

Further, in various embodiments of the present disclosure, $CO_2$ is used as a working fluid, wherein the $CO_2$ includes carbon dioxide which is chemically pure, carbon dioxide including some impurities in general terms, and a fluid in which carbon dioxide is mixed with one or more fluids as additives.

It is to be noted, in the present disclosure, that the terms "low temperature and "high-temperature" have relative meanings, thus should not be understood as being temperature higher or lower than a specific reference temperature. The terms "low pressure" and "high pressure" also should be understood as having relative meanings.

Components of the present disclosure are each interconnected by a transfer tube in which the working fluid flows, and unless specially mentioned, it is to be understood that the working fluid flows along the transfer tube. In the attached drawings, transfer tubes are indicated by those interconnecting lines of a system diagram which bear an associated reference number, and the flow of the working fluid will be described by assigning reference numerals to the transfer tube. However, when a plurality of components are integrated, the integrated configuration may be a component or general area effectively serving as the transfer tube. Therefore, even in this case, it is to be understood that the working fluid flows along the corresponding transfer tube. A flow path having a separate function will be additionally described.

The supercritical $CO_2$ power generating system described below is merely an example of possible system configurations, and is not limited to the described configuration.

FIG. 1 shows a supercritical $CO_2$ power generating system according to a first embodiment of the present disclosure.

As shown in FIG. 1, a supercritical $CO_2$ power generating system according to a first embodiment of the present disclosure may be configured to include a compressor or pump 100 which compresses and circulates a working fluid, a recuperator 200 which heats the working fluid, a plurality of external heat exchangers 300 which recover waste heat from waste heat gas as an external heat source to further heat the working fluid, a plurality of turbines 400 which are driven by the working fluid to produce electric power, and a condenser 500 for cooling the working fluid.

The pump 100 is driven by a second turbine 430 to be described later (see dotted line in FIG. 1) and compresses the working fluid 7A. The working fluid 1 that has passed through the pump 100 is branched into respective transfer tubes (8B, 2B) for the recuperator 200 and a low-temperature-side heat exchanger of the external heat exchanger 300.

The recuperator 200 exchanges heat between the working fluid 6 that has passed through the turbine 400 and the working fluid 1 that has passed through the pump 100, primarily cools the working fluid 6 and delivers the cooled working fluid 7B to the condenser 500, and heats the working fluid 1 and delivers the heated working fluid 2A to the high-temperature-side heat exchanger of the external heat exchanger 300.

A plurality of external heat exchangers 300 may be provided as needed. The present embodiment will describe an example in which two heat exchangers are provided. A first heat exchanger 310 and a second heat exchanger 330 use a gas having waste heat (hereinafter referred to as waste heat gas) as a heat source such as exhaust gas discharged from a boiler of a power plant. The first heat exchanger 310 and the second heat exchanger 330 each exchange heat between the waste heat gas and the working fluid to serve to heat the working fluid with the heat supplied from the waste heat gas.

In addition, the first heat exchanger 310 and the second heat exchanger 330 may be classified into exchangers of a relatively low temperature, medium temperature, high-temperature or the like depending on the temperature of the supplied waste heat gas. That is, the heat exchanger can perform heat exchange at the higher temperature if disposed nearer an inlet end into which the waste heat gas is introduced, and performs heat exchange at the lower temperature if disposed nearer an outlet end through which the waste heat gas is discharged.

In the present embodiment, the first heat exchanger 310 may be a heat exchanger using relatively high or medium-temperature waste heat gas compared to the second heat exchanger 330, and the second heat exchanger 330 may be a heat exchanger using relatively low or medium-temperature waste heat gas. That is, an example in which the first heat exchanger 310 and the second heat exchanger 330 are sequentially disposed from the inlet into which the waste heat gas is introduced toward the outlet will be described.

The turbine 400 includes a first turbine 410 and a second turbine 430, and drives a generator 450 connected to at least one of the turbines 410 and 430 to produce electric power. The working fluid is expanded while passing through the first turbine 410 and the second turbine 430, and thus the turbines 410 and 430 also serve as an expander. According to the present embodiment, the generator 450 is connected to the first turbine 410 to generate power, and the second turbine 430 serves to drive the pump 100. Therefore, the first turbine 410 may have a higher pressure than the second turbine 430.

The working fluid 3 heated by passing through the first heat exchanger 310 is branched into respective transfer tubes (4A, 4B) for the first turbine 410 and the second turbine 430, and the working fluids 5A and 5B passing through the first turbine 410 and the second turbine 430 are mixed at the rear end of the second turbine 430 and supplied to the recuperator 200 (6).

The condenser 500 serves as a cooler for cooling the working fluid 7B passing through the recuperator 200, using cooling air or cooling water as a refrigerant. The working fluid 7B is supplied to the condenser 500 to be cooled, and is then circulated to the pump 100 again (9).

Meanwhile, a recirculation pump 600 is provided between the working fluid outlet of the second heat exchanger 330 and the inlet of the second heat exchanger 330. That is, the working fluid of the outlet of the second heat exchanger 330 is branched before a working fluid (2C) delivered to the first heat exchanger 310 through the second heat exchanger 330 is mixed with the working fluid 2A introduced into the first heat exchanger 310. The branched working fluid 7C is introduced into the recirculation pump 600, where it is recompressed and then supplied to the inlet of the second heat exchanger 330 (7D).

In a typical combustion system, physical and chemical changes occur as the temperature of the combustion gas changes. Among these changes, it is important that sulfur trioxide react with water vapor to generate sulfuric acid. That is, gaseous sulfuric acid is generated as the temperature of the combustion gas gradually decreases. When it contacts a surface having a temperature lower than the temperature of the sulfuric acid vapor itself, the sulfuric acid vapor condenses into liquefied sulfuric acid.

In general, the dewpoint corrosion is closely related to the combustion of sulfur or sulfur-compound-containing fuels. Accordingly, the sulfur in the fuel is oxidized to form sulfur dioxide. Sulfur trioxide is generated when 1 to 3% of sulfur oxide directly reacts with oxygen atoms in the flame of the boiler. In addition, if ferrous oxide or vanadium pentaoxide, which serves as a catalyst, is present, oxidation reaction occurs to form sulfur trioxide. At this time, when the temperature falls below the dewpoint, sulfuric acid is generated and reacts with metal to cause corrosion.

What is important for corrosion to occur is the surface temperature of the metal, rather than the temperature of the combustion gas. The reason is that even if the temperature of the combustion gas is higher than the dewpoint, the corrosion occurs at a location where the temperature of the metal surface is lower than that of the dewpoint. Therefore, the surface temperature of a metal tube in the heat exchanger needs to be raised above the temperature of the dewpoint. The cold-end corrosion problem frequently occurs in the low-temperature-side heat exchanger that exchanges heat with the low-temperature waste heat gas. Therefore, the present disclosure proposes a method of controlling a temperature of a working fluid supplied to a low-temperature-side heat exchanger.

In order to prevent the cold-end corrosion of the low-temperature-side heat exchanger, the recirculation pump 600 is provided as in the above-described embodiment to partially recover the heat of the working fluid heated by passing through the low-temperature-side heat exchanger. In addition, since the working fluid is compressed by the recirculation pump 600 and is again heated to be re-supplied to the second heat exchanger 330, the working fluid is heated and supplied to above the temperature of the dewpoint of the waste heat gas. Generally, the temperature of the working fluid passing through the second heat exchanger 330 ranges from about 100 to 200° C. and the temperature of the working fluid passing through the condenser 500 and the pump 100 ranges from about 0 to 50° C. Accordingly, the working fluid passing through the second heat exchanger 330 may be partially drawn away and mixed with the working fluid passing through the recirculation pump 600 and the pump 100 to be in a range of 50 to 60° C., and then may be delivered to the second heat exchanger 330.

Hereinafter, the supercritical $CO_2$ power generating system according to another embodiment of the present disclosure will be described, while omitting description of components coincident with the above-described embodiment.

FIGS. 2 and 3 show a supercritical $CO_2$ power generating system according to second and third embodiments of the present disclosure, respectively. A recirculation pump side of FIGS. 1 to 3 is detailed in each of FIGS. 4 and 5. Here, the configuration of FIG. 5 is an alternative to that of FIG. 4.

As shown in FIG. 2, a supercritical $CO_2$ power generating system according to a second embodiment of the present disclosure can be configured by adding an external heat exchanger and a recuperator to the supercritical $CO_2$ power generating cycle according to the embodiment of FIG. 1.

That is, the supercritical $CO_2$ power generating system according to the second embodiment may include a sequential arrangement of a first heat exchanger 310' for recovering waste heat from a high-temperature waste heat gas, a second heat exchanger 330' for recovering waste heat from medium-temperature waste heat gas, and a third heat exchanger 350' for recovering waste heat from low-temperature waste heat gas. The system may further include a first recuperator 210' and a second recuperator 230' which are arranged in series and cool a working fluid passing through a first turbine 410' and a second turbine 430' and which heat a working fluid passing through the pump 100'. The first recuperator 210' is configured so that the working fluid passing through the first turbine 410' and the second turbine 430' is directly introduced and thus exchanges heat with a working fluid of a higher temperature than does the second recuperator 230'. Therefore, the first recuperator 210' is the high-temperature-side recuperator, and the second recuperator 230' is the low-temperature-side recuperator.

The recirculation pump 600' is installed as in the embodiment of FIG. 1, to connect between an outlet and an inlet of a third heat exchanger 350', which is a low-temperature-side heat exchanger.

The working fluid flow in the power generating cycle according to the second embodiment will be briefly described as follows.

The low-temperature working fluid compressed while passing through the pump 100' is branched from the rear end of the pump 100' and supplied to the second recuperator 230' and the third heat exchanger 350', respectively (10, 1).

The working fluid 1 supplied to the third heat exchanger 350' of the working fluid passing through the pump 100' is primarily heated by exchanging heat with the waste heat gas, and then supplied to the first recuperator 210' (2).

Of the working fluid passing through the pump 100', the working fluid 10 delivered to the second recuperator 230' is primarily heated by exchanging heat with the working fluid passing through the first recuperator 210' and then delivered to the second heat exchanger 330' (11). The working fluid passing through the turbine 400' is directly introduced into the first recuperator 210', and therefore exchanges heat with the working fluid having a temperature higher than the temperature of the working fluid supplied to the second recuperator 230'.

The working fluid 11 which is primarily heated by the second recuperator 230' and then delivered to the second heat exchanger 330' exchanges heat with the waste heat gas to be heated secondarily and is then supplied to the second turbine 430' (12). The working fluid passing through the first recuperator 210' is delivered to the first heat exchanger 310' (3) and exchanges heat with the waste heat gas to be heated secondarily and is then supplied to the first turbine 410' (4).

The working fluids 5 and 13 passing through the first turbine 410' and the second turbine 430' are mixed at the rear end of the second turbine 430' and supplied to the first recuperator 210', to exchange heat with the working fluid passing through the first heat exchanger 310' and be primarily cooled. The cooled working fluid is delivered to the second recuperator 230' (6 and 7), cooled further, and then supplied to the condenser 500' (8).

Part of the working fluid is branched from the outlet of the third heat exchanger 350' and is supplied to the recirculation pump 600' (8A), and the working fluid compressed at the recirculation pump 600 is mixed with the working fluid supplied to the third heat exchanger 350' (8B). The working fluid passing through the recirculation pump 600' is used to increase the temperature of the working fluid supplied from the pump 100' to 50 to 60° C., which is above the temperature of the dewpoint. The raised working fluid has the effect of increasing the surface temperature of the heat exchanger tube to the temperature of the dewpoint.

As shown in FIG. 3, the supercritical $CO_2$ power generating system according to the third embodiment of the present disclosure may include a series arrangement of the first heat exchanger 310 for recovering waste heat from a relatively high-temperature waste heat gas, and the second heat exchanger 330 for recovering waste heat from medium-temperature or low-temperature waste heat gas.

The recuperator 200 may include the first recuperator 210 and the second recuperator 230 which may be installed in series.

The turbine 400 may include the first turbine 410 supplied with the working fluid heated by passing through the first heat exchanger 310 and a second turbine 420*b* supplied with the working fluid recuperated from the first recuperator 210. At this time, the first turbine 410 may be configured to drive the generator 450, and the second turbine 430 may be configured to drive the pump 100.

The working fluid flow in the power generating cycle according to the third embodiment will be briefly described as follows.

The working fluid 1 passing through the pump 100 branches at the rear end of the pump 100 and supplied to the second recuperator 230 and the second heat exchanger 330, respectively (2A and 2B). The working fluid 2A primarily heated by the second recuperator 230 is mixed with the working fluid passing through the second heat exchanger 330 (3), and part of the working fluid 2A is supplied to the first heat exchanger 310 (4A) and a part thereof is supplied to the first recuperator 210 (4B).

The working fluid supplied to the first heat exchanger 310 is reheated and supplied to the first turbine 410 (5A), and delivered to the first recuperator 210 after driving the first turbine 410 (6A). The working fluid branched to the first recuperator 210 through the second heat exchanger 330 (4B) exchanged heat with the working fluid passing through the first turbine 410, and is heated again and then supplied to the second turbine 430 (5B). The working fluid passing through the second turbine 430 is supplied to the rear end of the first recuperator 210 (6B).

The working fluid primarily cooled by the first turbine 410 and the first recuperator 210 is delivered to the second recuperator 230 (7A) and exchanges heat with the working fluid passing through the pump 100 to be cooled. The cooled working fluid is delivered to the condenser 500 (8A), cooled, and then circulated back to the pump 100 (9).

Part of the working fluid is branched from the outlet of the second heat exchanger 330 and supplied to the recirculation pump 600 (8B), and the working fluid passing through a recirculation pump 600" is mixed with the working fluid supplied from a pump 100" to the second heat exchanger 330. The working fluid passing through the recirculation pump 600" is used to increase the temperature of the working fluid supplied from the pump 100" to 50 to 60° C. which is above the temperature of the dewpoint. The raised working fluid has the effect of increasing the surface temperature of the heat exchanger tube to the temperature of the dewpoint.

In the supercritical $CO_2$ power generating system according to the embodiments of the present disclosure having the above-described configuration, the flow rate control method of the recirculation pump serving as an auxiliary heating means to maintain the temperature of the working fluid introduced into the external heat exchanger having a temperature higher than the temperature of the dewpoint will be described. For convenience sake, reference will be made to the reference numerals of FIG. 1, but the detailed configurations of FIGS. 4 and 5 are configurations that are commonly applied to the above-described embodiments.

The flow rate of the working fluid branched from the outlet of the second heat exchanger 330 which is the low-temperature-side heat exchanger is controlled so as to maintain a preset temperature (for example, 55° C.) of the working fluid introduced into the external heat exchanger and may be controlled by a control valve 700.

As shown in FIG. 4, a control valve 700 may be provided at the outlet of the recirculation pump 600. In addition, a plurality of temperature indicating transmitters 710 are installed at a location which the working fluid is introduced into the second heat exchanger 330, which is the external heat exchanger, thereby measuring the temperature of the working fluid supplied to the second heat exchanger 330. The temperature indicating transmitter (TIT) 710 is connected to a temperature indicator, controller, and alarm (TICA) 730, and the temperature value measured by the temperature indicating transmitter 710 is transmitted to the temperature indicator, controller, and alarm 730. An interlock 750 is connected to the temperature indicator, controller, and alarm 730, and the recirculation pump 600 is provided with a variable frequency driver (VFD) 770 which controls power of a motor for driving the pump.

The temperature indicator, controller, and alarm 730 is a control device that performs temperature related display, control and alarm functions, and the interlock 750 is a device which checks temperature, pressure and the like in a compensation manner to control the operation. The variable frequency divider 770 is a device that reduces the power of the motor by controlling RPM of the motor when the system can be operated at a low pressure or a small flow rate.

A main control is performed based on the temperature of the inlet of the second heat exchanger 330 through the plurality of temperature indicating transmitters 710 which measure the temperature of the inlet of the second heat exchanger 330. In addition, the temperature of the rear end of the recirculation pump 600 and the pressure of the rear end of the pump 100 may be measured. To this end, the rear end of the pump 100 may be provided with a pressure indicating transmitter (PIT) 790. The interlock 750 can perform the control operation based on the temperature and pressure values, and measures the pressure of the rear end of the pump 100 to be utilized as the auxiliary means so that the recirculation pump 600 may generate the pressure equivalent to the pressure of the pump 100.

Therefore, the control signal of the temperature indicator, controller, and alarm 730 which receives the signal of the temperature indicating transmitter 710 and the measurement signal of the pressure indicating transmitter 790 are transmitted to the interlock 750. The opening of the control valve 700 and the power of the variable frequency divider 770 are controlled by the interlock 750.

For example, in the case of the pressure control, the power of the variable frequency divider 770 may be wasted when the pressure difference between the pressure of the working fluid discharged from the pump 100 and the pressure of the working fluid discharged from the variable frequency divider 770 is large. In order to prevent this, when the pressure difference occurs above the difference in the specific pressure, the control to reduce the power of the variable frequency divider 770 or the opening of the control valve 700 can be performed.

In the case of the temperature control, a thermodynamic function is built in the interlock 750 in advance, and the flow rate of the working fluid can be estimated after measuring temperatures at a plurality of locations through the temperature indicating transmitter 710. Thereafter, the variable frequency driver 770 and the opening of the control valve 700 can be controlled in a feed forward manner based on the thermodynamic calculation results.

Alternatively, as shown in FIG. 5, a location where the working fluid is introduced into the second heat exchanger 330 may be provided with only one temperature indicating transmitter 710'. When the plurality of temperature indicating transmitters are provided, the control accuracy can be improved, and when only one temperature indicating transmitter is provided, the cost reduction effect can be obtained in terms of the economic aspect.

It may be changed according to the design specifications of the supercritical $CO_2$ power generating system, but generally, the temperature of the working fluid heated by the waste heat gas in the low-temperature-side heat exchanger is approximately in the range of 100 to 200° C., and the temperature of the working fluid passing through the pump 100 is approximately in the range of 0 to 50° C.

Therefore, as in the above-described embodiments, part of the heat of the working fluid passing through the low-temperature-side heat exchanger by using the recirculation pump 600 may be mixed with the cold working fluid (2B) discharged from the rear end of the pump 100 to be used to increase the temperature of the working fluid supplied to the second heat exchanger 330. By doing so, the working fluid having the temperature higher than the temperature of the dewpoint of the waste gas of the external heat exchanger may be supplied.

The flow rate of the working fluid at the rear end of the recirculation pump 600 is controlled through the opening control of the control valve 700 as described above since the temperature of the rear end of the pump 100 is changed depending on the ambient temperature.

The relationship between the ambient temperature and the flow rate of the working fluid will be described in more detail as follows.

FIG. 6 is a graph showing the relationship between an ambient temperature and a flow rate of a working fluid of the recirculation pump according to the supercritical $CO_2$ power generating system of FIGS. 1 to 3, and FIG. 7 is a graph showing the relationship between an inlet temperature of the external heat exchanger and a flow rate of the working fluid of the recirculation pump according to the supercritical $CO_2$ power generating system of FIGS. 1 to 3.

As shown in FIG. 6, the ratio of the flow rate to be delivered to the recirculation pump 600 with respect to the flow rate of the inlet of the second heat exchanger 330 according to the ambient temperature shows a large difference according to the ambient temperature.

When the ambient temperature is low, the flow rate to be delivered to the recirculation pump 600 needs to be increased because the temperature at the rear end of the pump 100 is low. On the contrary, when the ambient temperature is high, the temperature at the rear end of the pump 100 is high, so that the flow rate to be delivered to the recirculation pump 600 may be reduced or gradually reduced to be zero.

Since the temperature at the rear end of the pump 100 is above 55° C. in the range where the ambient temperature of the condenser 500 or the temperature of the cooling water is 30 to 45° C., the separate recompressed flow rate is not required. However, as the ambient temperature or the temperature of the cooling water is reduced, a larger recompressed flow rate is required.

The flow rate to the recirculation pump 600 can be controlled by controlling the speed of the recirculation pump 600 to the motor VFD 770. However, when the pump 100 is not provided with the motor VFD, the pump 100 is operated at a fixed speed. At this time, the flow rate can be controlled by the opening of the control valve 700. In order to minimize the consumption power of the motor VFD 770, it is also possible to perform the compensation operation by measuring the differential pressure of the control valve 700 based on the flow rate control of the recirculation pump 600.

The above-described recompression flow rate control will be briefly described with reference to FIG. 7.

The inlet temperature of the second heat exchanger 330 is measured by the temperature sensor, and when the measured temperature is lower than the set value, the flow rate supplied to the recirculation pump 600 can be controlled to be increased.

Conversely, when the measured temperature is higher than the set value, the flow rate supplied to the recirculation pump 600 can be reduced to restore the inlet temperature of the second heat exchanger 330 to be within the set value range (normal operation range).

FIG. 8 is a schematic diagram showing a supercritical $CO_2$ power generating system according to a fourth embodiment of the present disclosure.

The fourth embodiment shown in FIG. 8 is different from the first embodiment shown in FIG. 1 in that the recirculation pump 600 is provided between the inlet of the condenser 500 and the inlet of the second heat exchanger 330, and the working fluid is branched from the front end of the condenser 500 to be introduced into the recirculation pump 600 (7C), recompressed, and then supplied to the inlet of the second heat exchanger 330 (7D).

In order to prevent the cold-end corrosion of the low-temperature-side heat exchanger, the recirculation pump 600 is provided as in the above-described embodiment to partially recover the heat of the working fluid which is discarded to the condenser 500. In addition, since the working fluid is compressed by the recirculation pump 600 and is again heated to be supplied to the second heat exchanger 330, the working fluid is heated and supplied to above the temperature of the dewpoint of the waste heat gas. Generally, the temperature of the working fluid discharged from the recuperator 200 to the condenser 500 is in the range of 0 to 50° C. and the working fluid passing through the recirculation pump 600 is in the range of 50 to 60° C.

FIG. 9 is a schematic diagram showing a supercritical $CO_2$ power generating system according to a fifth embodiment of the present disclosure, and FIG. 10 is a schematic diagram showing a supercritical $CO_2$ power generating system according to a sixth embodiment of the present disclosure.

As shown in FIG. 9, a supercritical $CO_2$ power generating system according to a fifth embodiment of the present disclosure can be configured by adding an external heat exchanger and a recuperator to the supercritical $CO_2$ power generating cycle according to the embodiment of FIG. 8.

That is, a first heat exchanger 310' for recovering waste heat from a high-temperature waste heat gas, a second heat exchanger 330' for recovering waste heat from medium-temperature waste heat gas, and a third heat exchanger 350' for recovering waste heat from low-temperature waste heat gas may be arranged sequentially.

In addition, a first recuperator 210' and a second recuperator 230' which are arranged in series and cools a working fluid passing through a first turbine 410' and a second turbine 430' and heats a working fluid passing through the pump 100' may be provided. The first recuperator 210' is configured so that the working fluid passing through the first turbine 410' and the second turbine 430' is directly introduced and thus exchanges heat with relatively higher-temperature working fluid than the second recuperator 230'. Therefore, the first recuperator 210' is the high-temperature-side recuperator, and the second recuperator 230' is the low-temperature-side recuperator.

The working fluid flow in the power generating cycle according to the fifth embodiment will be briefly described as follows.

The low-temperature working fluid compressed while passing through the pump 100' is branched from the rear end of the pump 100' and supplied to the second recuperator 230' and the third heat exchanger 350', respectively (10, 1).

The working fluid 1 supplied to the third heat exchanger 350' of the working fluid passing through the pump 100' is primarily heated by exchanging heat with the waste heat gas, and then supplied to the first recuperator 210' (2).

Of the working fluid passing through the pump 100', the working fluid 10 delivered to the second recuperator 230' is primarily heated by exchanging heat with the working fluid passing through the first recuperator 210' and then delivered to the second heat exchanger 330' (11). The working fluid passing through the turbine 400' is directly introduced into the first recuperator 210', and therefore exchanges heat with the working fluid having temperature higher than the temperature of the working fluid supplied to the second recuperator 230'.

The working fluid 11 which is primarily heated by the second recuperator 230' and then delivered to the second heat exchanger 330' exchanges heat with the waste heat gas to be heated secondarily and then supplied to the second turbine 430' (12). The working fluid passing through the first recuperator 210' is delivered to the first heat exchanger 310' (3) and exchanges heat with the waste heat gas to be heated secondarily and then supplied to the first turbine 410' (4).

The working fluids 5 and 13 passing through the first turbine 410' and the second turbine 430' are mixed at the rear end of the second turbine 430' and supplied to the first recuperator 210', and exchange heat with the working fluid passing through the first heat exchanger 310' to be primarily cooled. The cooled working fluid is delivered to the second recuperator 230' (6 and 7), re-cooled and then supplied to the condenser 500' (8).

Part of the working fluid at the inlet of the condenser 500' is branched to be supplied to the recirculation pump 600 (8A), and the working fluid compressed in the recirculation pump 600 is heated to 50 to 60° C. at which the tube surface temperature of the heat exchanger is above the dewpoint temperature, which is above the dewpoint temperature, to be supplied to the third heat exchanger 350' by (8B).

As shown in FIG. 10, the supercritical $CO_2$ power generating system according to the sixth embodiment of the present disclosure includes the first heat exchanger 310" for recovering waste heat from a relatively high-temperature waste heat gas, and the second heat exchanger 330" for recovering waste heat from medium-temperature or low-temperature waste heat gas which may be arranged in series.

The recuperator 200" may include the first recuperator 210" and the second recuperator 230" which may be installed in series.

The turbine 400" may include the first turbine 410" supplied with the working fluid heated by passing through the first heat exchanger 310" and a second turbine 430" supplied with the working fluid recuperated from the first recuperator 210". At this time, the first turbine 410" may be configured to drive the generator 450", and the second turbine 430" may be configured to drive the pump 100".

The working fluid flow in the power generating cycle according to the sixth embodiment will be briefly described as follows.

The working fluid 1 passing through the pump 100" is branched from the rear end of the pump 100" and supplied to the second recuperator 230" and the second heat exchanger 330", respectively (2A and 2"). The working fluid 2' primarily heated by the second recuperator 230" is mixed with the working fluid passing through the second heat exchanger 330" (3), and part of the working fluid 2' is supplied to the first heat exchanger 310" (4A) and a part thereof is supplied to the first recuperator 210" (4B).

The working fluid supplied to the first heat exchanger 310" is reheated and supplied to the first turbine 410" (5A), and delivered to the first recuperator 210" after driving the first turbine 410" (6A). The working fluid branched to the first recuperator 210" through the second heat exchanger 330" (4B) exchanged heat with the working fluid passing through the first turbine 410", and is heated again and then supplied to the second turbine 430" (5B). The working fluid passing through the second turbine 430" is supplied to the rear end of the first recuperator 210" (6B).

The working fluid primarily cooled by the first turbine 410" and the first recuperator 210" is delivered to the second recuperator 230" (7A) and exchanges heat with the working fluid passing through the pump 100" to be cooled. The cooled working fluid is delivered to the condenser 500" (8A), cooled, and then circulated back to the pump 100" (9).

Part of the working fluid at the inlet of the condenser 500" is branched to be supplied to the recirculation pump 600 (8B), and the working fluid compressed in the recirculation pump 600 is heated to 50 to 60° C. at which the tube surface temperature of the heat exchanger is above the dewpoint temperature, which is above the dewpoint temperature, to be supplied to the second heat exchanger 330" by (8C).

The specifications associated with FIGS. 4 to 7 may be applied to the fourth to sixth embodiments.

As described above, the working fluid may be heated to the dewpoint temperature or more of the waste heat gas by mixing the heat discarded to the condenser using the recirculation pump with the low-temperature working fluid at the rear end of the pump and supplied to the external heat exchanger. Accordingly, it is possible to increase the life of the external heat exchanger and improve the reliability of the external heat exchanger and the supercritical $CO_2$ power generating system by reducing the cold-end corrosion phenomenon of the low-temperature-side external heat exchanger.

The exemplary embodiments of the present disclosure described above and illustrated in the drawings should not be interpreted as limiting the technical idea of the present disclosure. The scope of the present disclosure is limited only by the accompanying claims, and those skilled in the art may modify and change the technical idea of the present disclosure in various forms. Therefore, it is obvious to those skilled in the art that these alterations and modifications fall within the scope of the present disclosure.

What is claimed is:

1. A power generating system using supercritical $CO_2$ as a working fluid for driving a turbine, the system comprising:

a plurality of heat exchangers for heating the working fluid using heat supplied from an external heat source, the plurality of heat exchangers including a low-temperature-side heat exchanger;

a pump for compressing the working fluid, the working fluid passing through the pump being branched into a first part of the working fluid and a second part of the working fluid for supplying the low-temperature-side heat exchanger;

a pump for compressing the working fluid, the working fluid passing through the pump being branched into a first part of the working fluid and a second part of the working fluid for supplying the low-temperature-side heat exchanger;

at least one recuperator for exchanging heat between the working fluid passing through the turbine and the first part of the working fluid passing through the pump, to cool the working fluid from the turbine and to heat the working fluid from the pump; and a condenser for cooling the working fluid primarily cooled by the at least one recuperator and supplying the cooled working fluid to the pump, wherein the second part of the working fluid passing through the pump is mixed with an additional part of the working fluid to be supplied to the low-temperature-side heat exchanger, and wherein the additional part of the working fluid to be supplied to the low-temperature-side heat exchanger is branched from an outlet of the low-temperature-side heat exchanger.

2. The system of claim 1, further comprising:

a recirculation pump for pressurizing the additional part of the working fluid to be supplied to the low-temperature-side heat exchanger.

3. The system of claim 2, wherein the plurality of heat exchangers use waste heat gas as the external heat source and include:

a high-temperature-side heat exchanger which is adjacent to an inlet end into which the waste heat gas is introduced from the external heat source, and the low-temperature-side heat exchanger which is adjacent to an outlet end from which the waste heat gas is discharged.

4. The system of claim 3, wherein the working fluid passing through the recirculation pump includes the additional part of the working fluid to be supplied to the low-temperature-side heat exchanger, and the working fluid supplied to the low-temperature-side heat exchanger is the mixture of the second part of the working fluid and the additional part of the working fluid, and wherein the temperature of the working fluid supplied to the low-temperature-side heat exchanger is above a dewpoint temperature of the waste heat gas supplied to the low-temperature-side heat exchanger.

5. The system of claim 4, further comprising:

a control valve connected to an outlet of the recirculation pump and configured to control a flow rate of the working fluid supplied to the low-temperature-side heat exchanger.

6. The system of claim 4, further comprising:

a variable frequency driver provided to the recirculation pump to control a flow rate of the working fluid supplied to the low-temperature-side heat exchanger.

7. The system of claim 4, further comprising:

at least one temperature indicating transmitter for measuring the temperature of the working fluid at the inlet of the low-temperature-side heat exchanger.

8. The system of claim 7, further comprising:

a controller connected to the temperature indicating transmitter to control, based on the measured temperature, a flow rate of the working fluid supplied to the low-temperature-side heat exchanger.

9. The system of claim 8, wherein the controller increases the flow rate of the working fluid supplied to the recirculation pump if the temperature of the waste heat gas introduced into the low-temperature-side heat exchanger is lower than a preset temperature.

10. The system of claim 8, wherein the controller decreases the flow rate of the working fluid supplied to the recirculation pump if the temperature of the waste heat gas introduced into the low-temperature-side heat exchanger is higher than a preset temperature.

11. The system of claim 8, wherein the controller increases the flow rate of the working fluid supplied to the recirculation pump if the temperature of the working fluid introduced into the low-temperature-side heat exchanger is lower than a preset temperature.

12. The system of claim 8, wherein the controller decreases the flow rate of the working fluid supplied to the recirculation pump if the temperature of the working fluid introduced into the low-temperature-side heat exchanger is higher than a preset temperature.

13. A power generating system using supercritical $CO_2$ as a working fluid for driving a turbine, the system comprising:

a plurality of heat exchangers for heating the working fluid using heat supplied from an external heat source, the plurality of heat exchangers including a low-temperature-side heat exchanger and at least one of a high-temperature-side heat exchanger and a middle-temperature heat exchanger;

a pump for compressing the working fluid, the working fluid passing through the pump being branched into a first part of the working fluid and a second part of the working fluid for supplying the low-temperature-side heat exchanger;

at least one recuperator for exchanging heat between the working fluid passing through the turbine and the first part of the working fluid passing through the pump, to cool the working fluid from the turbine and to heat the working fluid from the pump;

a condenser for cooling the working fluid primarily cooled by the at least one recuperator and supplying the cooled working fluid to the pump; and a recirculation pump connected to an outlet of the low-temperature-side heat exchanger to recirculate part of the working fluid discharged from the low-temperature-side heat exchanger, wherein the low-temperature-side heat exchanger is supplied with a mixture of the working fluid passing through the recirculation pump and the second part of the working fluid passing through the pump.

14. The system of claim 13, wherein the plurality of heat exchangers use waste heat gas as the external heat source and include:

a high-temperature-side heat exchanger which is adjacent to an inlet end into which the waste heat gas is introduced from the external heat source, and the low-temperature-side heat exchanger which is adjacent to an outlet end from which the waste heat gas is discharged.

15. The system of claim 14, wherein the mixture of the working fluid passing through the recirculation pump and the second part of the working fluid passing through the pump has a temperature above a dewpoint temperature of the waste heat gas supplied to the low-temperature-side heat exchanger.

16. A power generating system using supercritical $CO_2$ as a working fluid for driving a turbine, the system comprising:

a plurality of heat exchangers for heating the working fluid using heat supplied from an external heat source, the plurality of heat exchangers including a low-temperature-side heat exchanger and at least one of a high-temperature-side heat exchanger and a middle-temperature heat exchanger;

a pump for compressing the working fluid, the working fluid passing through the pump being branched into a first part of the working fluid and a second part of the working fluid for supplying the low-temperature-side heat exchanger;

at least one recuperator for exchanging heat between the working fluid passing through the turbine and the first part of the working fluid passing through the pump, to cool the working fluid from the turbine and to heat the working fluid from the pump;

a condenser for cooling the working fluid primarily cooled by the at least one recuperator and supplying the cooled working fluid to the pump; and a recirculation pump connected to an inlet of the condenser to recompress part of the working fluid supplied to the condenser, wherein the low-temperature-side heat exchanger is supplied with a mixture of the working fluid passing through the recirculation pump and the second part of the working fluid passing through the pump.

17. The system of claim 16, wherein the plurality of heat exchangers use waste heat gas as the external heat source and include:

a high-temperature-side heat exchanger which is adjacent to an inlet end into which the waste heat gas is introduced from the external heat source, and the low-temperature-side heat exchanger which is adjacent to an outlet end from which the waste heat gas is discharged.

18. The system of claim 17, wherein the mixture of the working fluid passing through the recirculation pump and the second part of the working fluid passing through the pump has a temperature above a dewpoint temperature of the waste heat gas supplied to the low-temperature-side heat exchanger.

* * * * *